US011088467B2

(12) United States Patent
Isom

(10) Patent No.: US 11,088,467 B2
(45) Date of Patent: Aug. 10, 2021

(54) PRINTED WIRING BOARD WITH RADIATOR AND FEED CIRCUIT

(71) Applicant: Raytheon Company, Waltham, MA (US)

(72) Inventor: Robert S. Isom, Allen, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/379,761

(22) Filed: Dec. 15, 2016

(65) Prior Publication Data

US 2018/0175512 A1 Jun. 21, 2018

(51) Int. Cl.

| | |
|---|---|
| ***H01Q 21/06*** | (2006.01) |
| ***H01Q 9/28*** | (2006.01) |
| ***H01Q 1/40*** | (2006.01) |
| ***H01Q 21/00*** | (2006.01) |
| ***H01Q 1/38*** | (2006.01) |
| ***H01Q 1/42*** | (2006.01) |
| ***H01Q 1/48*** | (2006.01) |
| ***H01Q 9/04*** | (2006.01) |
| ***H01Q 21/22*** | (2006.01) |
| ***H01Q 21/28*** | (2006.01) |

(52) U.S. Cl.

CPC ..... *H01Q 21/062* (2013.01); *H01Q 1/38* (2013.01); *H01Q 1/405* (2013.01); *H01Q 1/42* (2013.01); *H01Q 1/48* (2013.01); *H01Q 9/0428* (2013.01); *H01Q 9/285* (2013.01); *H01Q 21/0025* (2013.01); *H01Q 21/22* (2013.01); *H01Q 21/28* (2013.01)

(58) Field of Classification Search

CPC ..... H01Q 21/062; H01Q 9/0428; H01Q 21/0025; H01Q 21/26; H05K 1/181

See application file for complete search history.

(56) References Cited

U.S. PATENT DOCUMENTS

| | | | |
|---|---|---|---|
| 2,015,028 | A | 9/1935 | Gillette |
| 3,528,050 | A | 9/1970 | Hindenburg |
| 4,647,942 | A | 3/1987 | Counselman, III et al. |
| 4,690,471 | A | 9/1987 | Marabotto et al. |
| 5,172,082 | A | 12/1992 | Livingston et al. |

(Continued)

FOREIGN PATENT DOCUMENTS

| | | | |
|---|---|---|---|
| CN | 103247581 | A | 8/2013 |
| CN | 204857954 | U | 12/2015 |

(Continued)

OTHER PUBLICATIONS

U.S. Appl. No. 14/881,582, filed Oct. 13, 2015, Viscarra et al.

(Continued)

*Primary Examiner* — Ricardo I Magallanes

(74) *Attorney, Agent, or Firm* — Daly, Crowley Mofford & Durkee, LLP

(57) ABSTRACT

In one aspect, a unit cell of a phased array antenna includes a printed wiring board (PWB). The PWB includes a first layer comprising a radiator, a second layer comprising a feed circuit configured to provide excitation signals to the radiator, a plurality of vias connecting the feed circuit to the radiator, a signal layer, an active component layer comprising an active component bonded to the signal layer and a radio frequency (RF) connector connecting the signal layer to the feed circuit.

7 Claims, 11 Drawing Sheets

(56) References Cited

U.S. PATENT DOCUMENTS 5,410,281 A 4/1995 Blum
5,434,575 A * 7/1995 Jelinek ..... H01Q 21/062 342/365
5,453,751 A 9/1995 Tsukamoto et al.
5,455,546 A 10/1995 Frederick et al.
5,603,620 A 2/1997 Hinze et al.
5,644,277 A 7/1997 Gulick et al.
5,745,079 A 4/1998 Wang et al.
5,838,282 A 11/1998 Lalezari et al.
5,880,694 A 3/1999 Wang et al.
5,886,590 A 3/1999 Quan et al.
5,995,047 A 11/1999 Freyssinier et al.
6,100,775 A 8/2000 Wen
6,114,997 A * 9/2000 Lee ..... H01Q 1/38 343/700 MS
6,147,648 A 11/2000 Granholm et al.
6,184,832 B1 2/2001 Geyh et al.
6,320,542 B1 * 11/2001 Yamamoto ..... H01Q 1/38 343/700 MS
6,429,816 B1 8/2002 Whybrew et al.
6,459,415 B1 10/2002 Pachal et al.
6,512,487 B1 1/2003 Taylor et al.
6,664,867 B1 12/2003 Chen
6,686,885 B1 2/2004 Barkdoll et al.
6,856,297 B1 2/2005 Durham et al.
6,867,742 B1 3/2005 Irion, II et al.
6,876,336 B2 4/2005 Croswell et al.
6,882,247 B2 4/2005 Allison et al.
6,935,866 B2 8/2005 Kerekes et al.
6,977,623 B2 12/2005 Durham et al.
7,012,572 B1 3/2006 Schaffner et al.
7,084,827 B1 8/2006 Strange et al.
7,113,142 B2 9/2006 McCarville et al.
7,132,990 B2 11/2006 Stenger et al.
7,138,952 B2 11/2006 Mcgrath et al.
7,193,490 B2 3/2007 Shimoda
7,221,322 B1 5/2007 Durham et al.
7,272,880 B1 9/2007 Pluymers et al.
7,315,288 B2 1/2008 Livingston et al.
7,358,921 B2 4/2008 Snyder et al.
7,411,472 B1 8/2008 West et al.
7,414,590 B2 8/2008 Bij De Vaate et al.
7,688,265 B2 3/2010 Irion, II et al.
7,948,441 B2 5/2011 Irion, II et al.
8,035,992 B2 10/2011 Kushta et al.
8,325,093 B2 12/2012 Holland et al.
8,753,145 B2 6/2014 Lang et al.
9,136,572 B2 9/2015 Carr et al.
9,402,301 B2 7/2016 Paine et al.
9,437,929 B2 9/2016 Isom et al.
9,490,519 B2 11/2016 Lilly et al.
9,537,208 B2 1/2017 Isom
2003/0020654 A1 1/2003 Navarro et al.
2003/0112200 A1 6/2003 Marino
2003/0184476 A1 10/2003 Sikina et al.
2005/0007286 A1 * 1/2005 Trott ..... H01Q 13/085 343/770
2005/0156802 A1 7/2005 Livingston et al.
2006/0038732 A1 2/2006 Deluca et al.
2006/0097947 A1 5/2006 McCarville et al.
2008/0036665 A1 2/2008 Schadler
2008/0150832 A1 6/2008 Ingram et al.
2008/0169992 A1 7/2008 Ortiz et al.
2008/0316131 A1 12/2008 Apostolos et al.
2009/0073075 A1 3/2009 Irion, II et al.
2009/0091506 A1 4/2009 Navarro et al.
2009/0121967 A1 5/2009 Cunningham
2009/0231225 A1 9/2009 Choudhury et al.
2009/0284415 A1 * 11/2009 Worl ..... H01Q 21/061 342/372
2010/0164783 A1 7/2010 Choudhury et al.
2010/0245202 A1 9/2010 Lewis et al.
2011/0089531 A1 4/2011 Hillman et al.
2012/0034820 A1 2/2012 Lang et al.
2012/0068906 A1 3/2012 Asher et al.
2012/0098706 A1 4/2012 Lin et al.
2012/0146869 A1 * 6/2012 Holland ..... H01Q 21/061 343/795
2012/0212386 A1 * 8/2012 Massie ..... H01Q 9/0492 343/850
2012/0287581 A1 11/2012 Sauerbier et al.
2012/0306698 A1 12/2012 Warnick et al.
2012/0313818 A1 12/2012 Puzella et al.
2013/0026586 A1 1/2013 Seok et al.
2013/0050055 A1 2/2013 Paradiso et al.
2013/0175078 A1 7/2013 Pai
2013/0187830 A1 * 7/2013 Warnick ..... H01Q 5/35 343/893
2013/0194754 A1 8/2013 Jung et al.
2013/0207274 A1 8/2013 Liu et al.
2013/0314292 A1 11/2013 Maley
2014/0132473 A1 * 5/2014 Isom ..... H01Q 21/0006 343/855
2014/0264759 A1 9/2014 Koontz et al.
2015/0015453 A1 1/2015 Puzella et al.
2015/0200460 A1 7/2015 Isom et al.
2015/0263435 A1 * 9/2015 Song ..... H01Q 21/26 343/810
2015/0353348 A1 12/2015 Vandemeer et al.
2016/0104934 A1 * 4/2016 Jang ..... H01Q 5/378 343/834
2016/0172755 A1 6/2016 Chen et al.
2016/0352023 A1 12/2016 Dang et al.
2018/0040955 A1 * 2/2018 Vouvakis ..... H01Q 5/25
2018/0090851 A1 3/2018 Feldman et al.
2018/0337461 A1 11/2018 Kildal et al.

FOREIGN PATENT DOCUMENTS

EP 1 970 952 A2 9/2008
EP 1 970 952 A3 9/2008
JP U-1992027609 3/1992
JP H07-106841 4/1995
JP 2000-312112 A 11/2000
JP 2006-504375 A 2/2006
JP 2008-244581 A 10/2008
JP 2012-044653 A 3/2012
JP 2012-174874 A 9/2012
JP 6195935 B2 9/2017
KR 10-2011-0091574 A 8/2011
KR 10-2015-0120414 A 10/2015
TW 2014-03765 A 4/2014
TW 2014-34203 A 9/2014
TW 2016-05017 A 2/2016
WO WO 2009/077791 A1 6/2009
WO WO 2014/168669 A1 10/2014
WO WO 2015/006293 A1 1/2015
WO WO 2016/138267 A1 9/2016
WO WO 2016/138267 A8 9/2016

OTHER PUBLICATIONS

U.S. Office Action dated Jun. 8, 2015 corresponding to U.S. Appl. No. 13/674,547; 23 Pages.
Response to U.S. Office Action dated Jun. 8, 2015 corresponding to U.S. Appl. No. 13/674,547; Response filed on Aug. 28, 2015; 18 Pages.
U.S. Final Office Action dated Dec. 3, 2015 corresponding to U.S. Appl. No. 13/674,547; 22 Pages.
Response to U.S. Final Office Action dated Dec. 3, 2015 corresponding to U.S. Appl. No. 13/674,547; Response filed on Feb. 22, 2016; 16 Pages.
U.S. Office Action dated Apr. 7, 2016 corresponding to U.S. Appl. No. 13/674,547; 27 Pages.
Response to U.S. Office Action dated Apr. 7, 2016 corresponding to U.S. Appl. No. 13/674,547; Response filed on Jun. 21, 2016; 16 Pages.
U.S. Final Office Action dated Jul. 1, 2016 corresponding to U.S. Appl. No. 13/674,547; 30 Pages.

(56) References Cited

OTHER PUBLICATIONS

Response to U.S. Final Office Action dated Jul. 1, 2016 corresponding to U.S. Appl. No. 13/674,547; Response filed on Aug. 18, 2016; 14 Pages.
Notice of Allowance dated Sep. 16, 2016 corresponding to U.S. Appl. No. 13/674,547; 17 Pages.
PCT International Search Report and Written Opinion dated Jun. 28, 2013 corresponding to International Application No. PCT/US2013/038408; 14 Pages.
PCT International Preliminary Report dated May 21, 2015 corresponding to International Application No. PCT/US2013/038408; 9 Pages.
European 161/162 Communication dated Jul. 9, 2015 corresponding to European Application No. 13721516.6; 2 Pages.
Response (with Amended Claims) to European 161/162 Communication dated Jul. 9, 2015 corresponding to European Application No. 13721516.6; Response filed on Jan. 19, 2016; 34 Pages.
Korean Office Action (with English Translation) dated Feb. 27, 2016 corresponding to Korean Application No. 10-2015-7010618; 4 Pages.
Response (with Foreign Associate Reporting Letter) to Korean Office Action dated Feb. 27, 2016 corresponding to Korean Application No. 10-2015-7010618; Response filed on Apr. 27, 2016; 15 Pages.
Japanese Office Action (with English Translation) dated Jun. 21, 2016 corresponding to Japanese Application No. 2015-541757; 8 Pages.
Response (with Foreign Associate Reporting Letter) to Japanese Office Action dated Jun. 21, 2016 corresponding to Japanese Application No. 2015-541757; Response filed on Sep. 21, 2016; 7 Pages.
PCT International Search Report and Written Opinion dated Aug. 30, 2016 corresponding to International Application No. PCT/US2016/034045; 11 Pages.
Hotte et al., "Directive and High-Efficiency Slotted Waveguide Antenna Array for V-Band Made by Wire Electrical Discharge Machining;" Electronics Letters, vol. 51, No. 5; Mar. 5, 2015; 2 Pages.
Kasemodel et al., "Broadband Array Antenna Enhancement with Spatially Engineered Dielectric;" U.S. Appl. No. 13/590,769, filed Aug. 21, 2012; 19 Pages.
Kasemodel et al., "Broadband Planar Wide-Scan Array Employing Tightly Coupled Elements and Integrated Balun;" Proceedings of the IEEE International Symposium on Phased Array Systems and Technology (ARRAY); Oct. 12-15, 2010; 6 Pages.
Kindt et al., "Polarization Correction in Dual-Polarized Phased Arrays of Flared Notches;" Proceedings of the IEEE International Symposium on Antennas and Propagation (APSURSI); Jul. 3-8, 2011; 4 Pages.
Mishra et al., "Array of SIW Resonant Slot Antenna for V Band Applications;" Proceedings of the International Conference on Microwave and Photoics (ICMAP); Dec. 13-15, 2013; 4 Pages.
Nesic et al., "Wideband Printed Antenna with Circular Polarization;" Proceedings of the IEEE Antennas and Propagation Society International Symposium; Jul. 13-18, 1997; 4 Pages.
Wong et al., "Broad-Band Single-Patch Circularly Polarized Microstrip Antenna with Dual Capacitively Coupled Feeds;" Proceedings of the IEEE Transactions on Antennas and Propagation, vol. 49, No. 1; Jan. 2001; 4 Pages.
Wong et al., "Design of Dual-Polarized L-Probe Patch Antenna Arrays With High Isolation;" Proceedings of the IEEE Transactions on Antennas and Propagation, vol. 52, No. 1; Jan. 2004; 8 Pages.
Wu et al., "A Wideband High-Gain High-Efficiency Hybrid Integrated Plate Array Antenna for V-Band Inter-Satellite Links;" Proceedings of the IEEE Transactions on Antennas and Propagation, vol. 63, No. 4; Apr. 2015; 9 Pages.
Chang-Chien et al., "MMIC Compatible Wafer-Level Packaging Technology;" Proceedings of the International Conference on Indium Phosphide and Related Materials (19th IPRM); May 14-18, 2007; 4 Pages.
Chang-Chien et al., "MMIC Packaging and Heterogeneous Integration Using Wafer-Scale Assembly;" Proceedings of the CS MANTECH Conference; May 14-17, 2007; 4 Pages.
Chang-Chien, "Wafer-Level Packaging and Wafer-Scale Assembly Technologies;" Presentation by Northrop Grumman Aerospace Systems (NGAS); Proceedings of the CS MANTECH Workshop 6; May 17, 2010; 43 Pages.
Green, "DARPA's Heterogeneous Integration Vision and Progress on Modular Design;" Presentation by DARPA; Proceedings of the 3D Architectures for Semiconductor Integration and Packaging Conference (ASIP); Dec. 17, 2015; 17 Pages.
Gu et al., "W-Band Scalable Phased Arrays for Imaging and Communications;" Integrated Circuits for Communications, IEEE Communications Magazine; Apr. 2015; 9 Pages.
Popovic, "Micro-coaxial Micro-fabricated Feeds for Phased Array Antennas;" Proceedings of the 2010 IEEE International Symposium on Phased Array Systems and Technology (ARRAY); Oct. 12-15, 2010; 10 Pages.
Shin et al., "A 108-114 GHz 4×4 Wafer-Scale Phased Array Transmitter with High-Efficiency On-Chip Antennas;" IEEE Journal of Solid-State Circuits, vol. 48, No. 9; Sep. 2013; 15 Pages.
U.S. Appl. No. 15/381,286, filed Dec. 16, 2016, Teshiba et al.
U.S. Appl. No. 15/379,775, filed Dec. 15, 2016, Isom et al.
Urteaga, "3D Heterogeneous Integration of III-V Devices and Si CMOS;" Presentation by Teledyne Scientific Company; Proceedings of the 3D Architectures for Semiconductor Integration and Packaging Conference (ASIP); Dec. 17, 2015; 26 Pages.
Zihir et al., "A 60 GHz 64-element Wafer-Scale Phased-Array with Full-Reticle Design;" Proceedings of the 2015 IEEE MTT-S International Microwave Symposium; May 17-22, 2015; 3 Pages.
U.S. Non-Final Office Action dated May 18, 2017 for U.S. Appl. No. 14/881,582; 21 Pages.
PCT International Search Report and Written Opinion dated Jan. 3, 2018 for International Application No. PCT/US2017/055059; 17 Pages.
PCT International Search Report and Written Opinion dated Jan. 3, 2018 for International Application No. PCT/US2017/055222; 16 Pages.
Luo et al.; "Meander Line Coupled Cavity-Backed Slot Antenna for Broadband Circular Polarization"; IEEE Antennas and Wireless Propagation Letters; vol. 14; Feb. 2, 2015; 4 Pages.
Response to U.S. Non-Final Office Action dated May 18, 2017 for U.S. Appl. No. 14/881,582; Response filed on Jun. 5, 2017; 7 Pages.
Notice of Allowance dated Jun. 23, 2017 for U.S. Appl. No. 14/881,582; 8 Pages.
PCT International Search Report and Written Opinion dated Dec. 8, 2017 for International Application No. PCT/US2017/054836; 15 Pages.
Japanese Office Action dated Feb. 28, 2017 for Japanese Pat. App. No. 2015-541757 with English Translations; 4 Pages.
U.S. Non-Final Office Action dated Apr. 5, 2018 for U.S. Appl. No. 15/379,775; 16 Pages.
PCT International Preliminary Report and Written Opinion dated Apr. 26, 2018 for International Application No. PCT/US2016/034045; 8 Pages.
Response to U.S. Non-Final Office Action dated Apr. 5, 2018 for U.S. Appl. No. 15/379,775; Response filed Aug. 1, 2018; 17 Pages.
Tong et al., "Novel Sequential Rotation Technique for Broadband Circularly Polarized Microstrip Ring Antennas;" Loughborough Antennas & Propagation Conference; Mar. 17, 2008; 4 Pages.
PCT International Search Report and Written Opinion dated Apr. 26, 2018 for International Application No. PCT/US2018/015421; 15 Pages.
Taiwan Office Action (with Search Report) dated Jun. 19, 2018 for Taiwan Application No. 106135418; 18 Pages.
U.S. Non-Final Office Action dated Jul. 5, 2018 for U.S. Appl. No. 15/381,286; 8 Pages.
Response (with English Translation of Response, Current Claims and Amended Specification) to Taiwan Office Action dated Jun. 19, 2018 for Taiwan Application No. 106135418; Response filed on Sep. 12, 2018; 40 Pages.
Response to U.S. Non-Final Office Action dated Jul. 5, 2018 for U.S. Appl. No. 15/381,286; Response filed on Sep. 6, 2018; 8 Pages.

(56) References Cited

OTHER PUBLICATIONS

U.S. Final Office Action dated Sep. 21, 2018 for U.S. Appl. No. 15/379,775; 19 Pages.
U.S. Non-Final Office Action dated Oct. 9, 2018 for U.S. Appl. No. 15/731,906; 13 Pages.
Response to U.S. Non-Final Office Action dated Oct. 9, 2018 for U.S. Appl. No. 15/731,906; Response filed Nov. 16, 2018; 12 Pages.
Taiwan Examination Report (with English Translation) dated Oct. 31, 2018 for Taiwan Application No. 106135617; 23 Pages.
Taiwan Examination Report (with English Translation) dated Nov. 2, 2018 for Taiwan Application No. 106135613; 20 Pages.
Taiwan Examination Report (with English Translation) dated Nov. 26, 2018 for Taiwan Application No. 106135418; 8 Pages.
Taiwan Examination Report and Search Report (with English Translation) dated Apr. 15, 2019 for Taiwan Application No. 106135617; 21 Pages.
Response to Non-Final Office Action dated Feb. 27, 2019 for U.S. Appl. No. 15/381,286; Response filed May 21, 2019; 12 Pages.
Response (with Machine English Translation from Google Translator) to Taiwan Examination Report dated Apr. 15, 2019 for Taiwan Application No. 106135617; Response filed Jul. 4, 2019; 18 Pages.
Response to U.S. Final Office Action dated Jun. 11, 2019 for U.S. Appl. No. 15/381,286; Response filed Jul. 17, 2019; 7 Pages.
Taiwan Statement of Reasons for Re-Examination (with English Translation & Reporting Letter dated Jan. 8, 2019) dated Jan. 8, 2019 for Taiwan Application No. 106135418; 7 Pages.
Response to U.S. Final Office Action dated Jan. 2, 2019 for U.S. Appl. No. 15/381,286; Response and RCE filed Feb. 5, 2019; 10 Pages.
U.S. Non-Final Office Action dated Feb. 27, 2019 for U.S. Appl. No. 15/381,286; 17 Pages.
Taiwan Allowance Decision (with English Translation) dated Mar. 20, 2019 for Taiwan Application No. 106135613; 4 Pages.
Japanese Final Office Action (with English Translation) dated Feb. 28, 2017 for Japanese Application No. 2015-541757; 4 Pages.
European Examination Report dated Jun. 21, 2018 for European Application No. 13721516.6; 6 Pages.
Response to European Examination Report dated Jun. 21, 2018 for European Application No. 13721516.6; Response filed Oct. 26, 2018; 16 Pages.
U.S. Notice of Allowance dated Apr. 4, 2019 for U.S. Appl. No. 15/731,906; 5 Pages.
Response to U.S. Non-Final Office Action dated Jan. 14, 2019 for U.S. Appl. No. 15/379,775; Response filed Apr. 25, 2019; 10 Pages.
U.S. Final Office Action dated Jan. 2, 2019 for U.S. Appl. No. 15/381,286; 16 Pages.
Response to U.S. Final Office Action dated Sep. 21, 2018 for U.S. Appl. No. 15/379,775; Response filed Dec. 21, 2018; 13 Pages.
U.S. Non-Final Office Action dated Jan. 14, 2019 for U.S. Appl. No. 15/379,775; 22 Pages.
U.S. Notice of Allowance dated Dec. 14, 2018 for U.S. Appl. No. 15/731,906; 9 Pages.
Response (with English Translation, Claims and Specification) to Taiwan Examination Report dated Oct. 31, 2018 for Taiwan Application No. 106135617; Response filed Jan. 7, 2019; 22 Pages.
Response (with English Translation and Specification) to Taiwan Examination Report dated Nov. 2, 2018 for Taiwan Application No. 106135613; Response filed Jan. 8, 2019; 9 Pages.
U.S. Final Office Action dated Jun. 11, 2019 for U.S. Appl. No. 15/381,286; 18 Pages.
PCT International Preliminary Report dated Jun. 27, 2019 for International Application No. PCT/US2017/054836; 9 Pages.
PCT International Preliminary Report dated Jun. 27, 2019 for International Application No. PCT/US2017/055059; 13 Pages.
PCT International Preliminary Report dated Jun. 27, 2019 for International Application No. PCT/US2017/055222; 9 Pages.
European Communication Pursuant to Rules 161(1) and 162 EPC dated Jul. 23, 2019 for European Application No. 17785128.4; 3 Pages.
European Communication Pursuant to Rules 161(1) and 162 EPC dated Jul. 23, 2019 for European Application No. 17791226.8; 3 Pages.
European Communication Pursuant to Rules 161(1) and 162 EPC dated Jul. 23, 2019 for European Application No. 17784814.0; 3 Pages.
Korean Notice of Preliminary Rejection (with English Translation) dated Dec. 19, 2019 for Korean Application No. 10-2019-7013632; 11 Pages.
Taiwan Allowance Decision (with English Translation) dated Dec. 23, 2019 for Taiwan Application No. 106135418; 3 Pages.
Response (with English Translation) to Taiwan Examination Report dated Sep. 20, 2019 for Taiwan Application No. 106135418; Response filed Dec. 10, 2019; 12 Pages.
Examination Report dated Sep. 9, 2019 for European Application No. 13721516.6; 4 Pages.
U.S. Notice of Allowance dated Sep. 5, 2019 for U.S. Appl. No. 15/381,286; 13 Pages.
U.S. Notice of Allowance dated Sep. 17, 2019 for U.S. Appl. No. 15/379,775; 16 Pages.
Taiwan Office Action (with English Translation) dated Sep. 20, 2019 for Taiwan Application No. 106135418; 14 Pages.
Response (with Amended Claims) to European Examination Report dated Sep. 9, 2019 for European Application No. 13721516.6; Response filed Jan. 17, 2020; 6 Pages.
Response (with Amended Claims) to European Rule 161/162 Communication dated Jul. 23, 2019 for European Application No. 17785128.4; Response filed Jan. 27, 2020; 16 Pages.
Response (with Amended Claims) to European Rule 161/162 Communication dated Jul. 23, 2019 for European Application No. 17784814.0; Response filed Feb. 3, 2020; 24 Pages.
Response (with Machine English Translation) to Korean Office Action dated Dec. 19, 2019 for Korean Application No. 10-2019-7013632; Response filed Feb. 17, 2020; 33 Pages.
PCT International Preliminary Report dated Feb. 13, 2020 for International Application No. PCT/US2018/015421; 9 Pages.
Korean Office Action (with English Translation) dated Jul. 10, 2020 for Korean Application No. 10-2019-7010632; 13 Pages.
European Examination Report dated Jul. 29, 2020 for European Application No. 17784814.0; 7 Pages.
Japanese Decision to Grant (with Machine English Translation and Allowed Claims) dated Aug. 3, 2020 for Japanese Application No. 2019-525735; 7 Pages.
Response (with Machine English Translation) to Korean Office Action dated May 13, 2020 for Korean Application No. 10-2019-7012561; Response filed Jun. 1, 2020; 35 Pages.
Chinese First Office Action (with English Translation) dated Jul. 27, 2020 for Chinese Application No. 201780066115.2; 18 Pages.
Response (with Machine English Translation from Espacenet.com) to Korean Office Action dated Jul. 10, 2020 for Korean Application No. 10-2019-7010632; Response filed Aug. 19, 2020; 44 Pages.
Japanese Office Action (with English Translation) dated Aug. 18, 2020 for Japanese Application No. 2019-531284; 12 Pages.
European Rule 161/162 Communication dated Mar. 11, 2020 for European Application No. 18704713.9; 3 Pages.
Korean Notice of Rejection (with English Translation) dated May 13, 2020 for Korean Application No. 10-2019-7012561; 6 Pages.
Response to European Rule 161/162 Communication dated Mar. 11, 2020 for European Application No. 17791226.8; Response filed Jun. 1, 2020; 17 Pages.
Korean Notice of Allowance (with Machine English Translation and Allowed Claims) dated May 27, 2020 for Korean Application No. 10-2019-7013632; 6 Pages.
Response (with Machine English Translation from Espacenet.com) to Japanese Office Action dated Sep. 1, 2020 for Japanese Application No. 2019-531220; Response filed Nov. 26, 2020; 11 Pages.
Korean Office Action (with English Translation) dated Dec. 1, 2020 for Korean Application No. 10-2019-7012561; 9 Pages.
European Intention to Grant dated Nov. 10, 2020 for European Application No. 17785128.4; 5 Pages.
Response (with Machine English Translation from Espacenet.com) to Korean Office Action dated Sep. 23, 2020 for Korean Application No. 10-2019-7038981; Response filed Nov. 24, 2020; 25 Pages.

(56) References Cited

OTHER PUBLICATIONS

Response to European Examination Report dated Jul. 29, 2020 for European Application No. 17784814.0; Response filed Dec. 4, 2020; 15 Pages.
Response (with Machine English Translation) to Chinese First Office Action dated Jul. 27, 2020 for Chinese Application No. 201780066115.2; Response filed Dec. 10, 2020; 17 Pages.
Korean Decision to Grant (with Machine English Translation) dated Dec. 7, 2020 for Korean Application No. 10-2019-7010632; 9 Pages.
Japanese Decision to Grant (with Machine English Translation from Espacenet.com) with Allowed Claims dated Nov. 27, 2020 for Japanese Application No. 2019-531284; 8 Pages.
Japanese Office Action (with Machine English Translation) dated Sep. 1, 2020 for Japanese Application No. 2019-531220; 17 Pages.
Response (with Machine English Translation from Espacenet.com) to Korean Office Action dated Dec. 1, 2020 for Korean Application No. 10-2019-7012561; Response filed Dec. 28, 2020; 22 Pages.
Response (with Machine English Translation from Espacenet.com) to Japanese Office Action dated Aug. 18, 2020 for Japanese Application No. 2019-531284; Response filed Nov. 12, 2020; 12 Pages.
Office Action dated Sep. 23, 2020 for Korean Application No. 10-2019-7038981 with English Translation; 5 Pages.
Secondary European Response (with Amended Claims) filed on Sep. 24, 2020 for European Application No. 17785128.4; 9 Pages.
Japanese Notice of Allowance (with Machine English Translation from Epsacenet.com and Allowed Claims) dated Feb. 2, 2021 for Japanese Application No. 2019-531220; 9 Pages.
2$^{nd}$ Chinese Office Action (with English Translation) dated Apr. 2, 2021 for Chinese Application No. 201780066115.2; 6 Pages.
Examination Report dated Mar. 19, 2021 for European Application No. 13721516.6; 5 Pages.
European Examination Report dated Feb. 12, 2021 for European Application No. 17791226.8; 8 Pages.
Response to European Examination Report dated Feb. 12, 2021 for European Application No. 17791226.8; Response filed on Jun. 22, 2021; 18 Pages.

* cited by examiner

PRINTED WIRING BOARD WITH RADIATOR AND FEED CIRCUIT

BACKGROUND

Performance of an array antenna is often limited by the size and bandwidth limitations of the antenna elements which make up the array. Improving the bandwidth while maintaining a low profile enables array system performance to meet bandwidth and scan requirements of next generation of communication applications, such as software defined or cognitive radio. These applications also frequently require antenna elements that can support either dual linear or circular polarizations.

SUMMARY

In one aspect, a unit cell of a phased array antenna includes a printed wiring board (PWB). The PWB includes a first layer comprising a radiator, a second layer comprising a feed circuit configured to provide excitation signals to the radiator, a plurality of vias connecting the feed circuit to the radiator, a signal layer, an active component layer comprising an active component bonded to the signal layer and a radio frequency (RF) connector connecting the signal layer to the feed circuit.

In another aspect, a unit cell of a phased array antenna includes a printed wiring board (PWB). The PWB includes a first layer comprising a radiator that includes a first dipole arm, a second dipole arm, a third dipole arm and a fourth dipole arm. The PWB also includes a second layer that includes a quadrature feed circuit configured to provide excitation signals to the radiator using right hand circular polarization (RHCP). The PWB further includes a first via coupled to the first dipole arm, a second via coupled to the second dipole arm, a third via coupled to the third dipole arm, a fourth via coupled to the fourth dipole arm, wherein the first, second, third and fourth vias provide the excitation signal from the feed circuit, a fifth via coupled to the first dipole arm, a sixth via coupled to the second dipole arm, a seventh via coupled to the third dipole arm and an eighth via coupled to the fourth dipole arm, wherein the fifth, sixth, seventh and eighth vias provide ground. The PWB still further includes a third layer between the first and second layers, wherein the third layer comprises a dielectric having four rounded corners evenly spaced around the dialectic.

In a further aspect, a unit cell of a phased array antenna includes a first means for providing a radiated signal, a second means for generating excitation signals and a third means for providing the excitation signals from the second means to the first means.

DETAIL DESCRIPTION

Described herein is a phased array antenna that includes one or more unit cells. A unit cell includes a printed wiring board (PWB) that includes a radiator on a single layer of the PWB and a feed circuit on a single layer of the PWB. In one example, the radiator is a current loop radiator.

Current loop radiators described herein use low-cost materials compatible with FR4 processing thereby eliminating the need for higher cost materials to achieve performance over frequency and scan. Bandwidth in terms of frequency and scan volume can be improved in radiators by designing them with lower dielectric materials that are closer to air. But these materials typically result in increased material costs and/or fabrication complexity. Radiating structures that are naturally low-Q, high bandwidth, such as the current loop described herein, offer improved performance compared to elements such as the patch radiator that have inherently higher-Q and have less bandwidth. The current loop radiator designed for air instead of a dielectric has a bandwidth of more than 8:1 in both single and dual-polarized configurations. A current loop radiator described herein with a higher dielectric constant material achieves better axial ratio and insertion loss performance over scan and at a wider frequency bandwidth than was achieved with the previous patch radiator designs. The current loop radiator described herein also achieves significantly less variance over manufacturing tolerances than that achieved with the patch radiator.

Additionally, a current loop radiator described herein on oversized rectangular lattice achieves superior loss performance and maintain axial ratio performance near, at, and beyond grating lobe incidence better than prior art radiator designs, such as patch radiators. The grounded structure of the current loop described herein suppresses the scan blindness that typically causes large gain drops and impedance mismatch at and near grating lobe incidence. Further, the current loop radiator described herein can achieve axial ratio of less than 2 dB to be achieved out to 50-degree scan in both E- and H-Planes without any need for amplitude and phase adjustments between the linear components forming right hand circular polarization (RHCP). Because of this it is possible to cut the number of monolithic microwave integrated circuit (MIMIC) chips in half, saving significant cost and power without sacrificing receiver (RX) performance. An improvement in power and cost is possible for a transmitter (TX) (compressed) operation, but, in that case, halving the number of MIMIC chips reduces the effective isotropic radiated power (EIRP) by 3 dB all other things remaining the same.

Figure 1A:
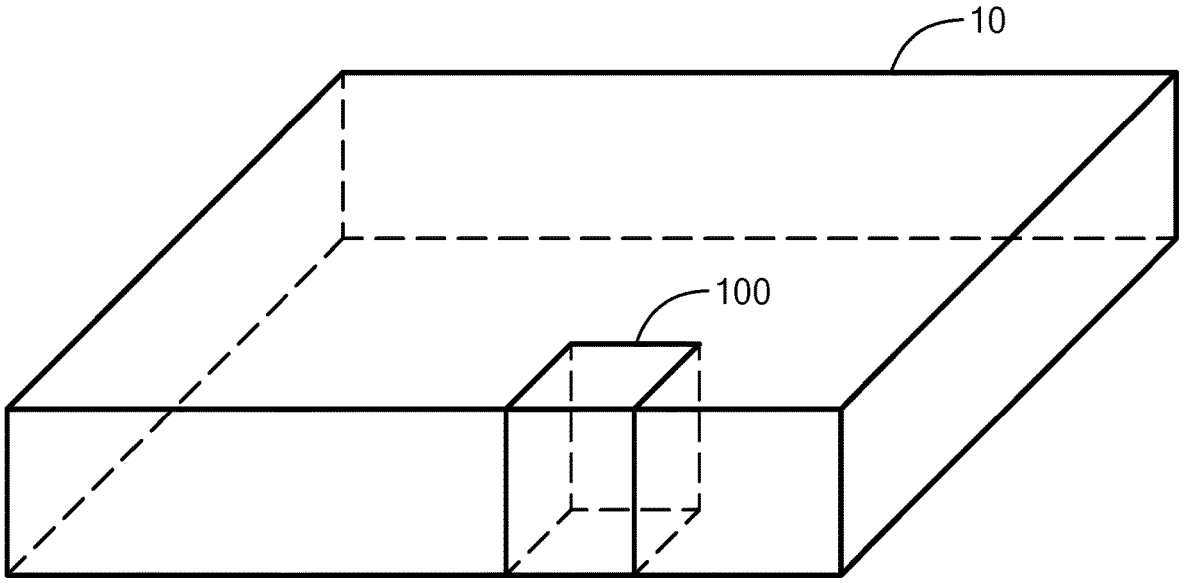
FIG. 1A is a diagram of an example of a phased antenna array.
Figure 1B:
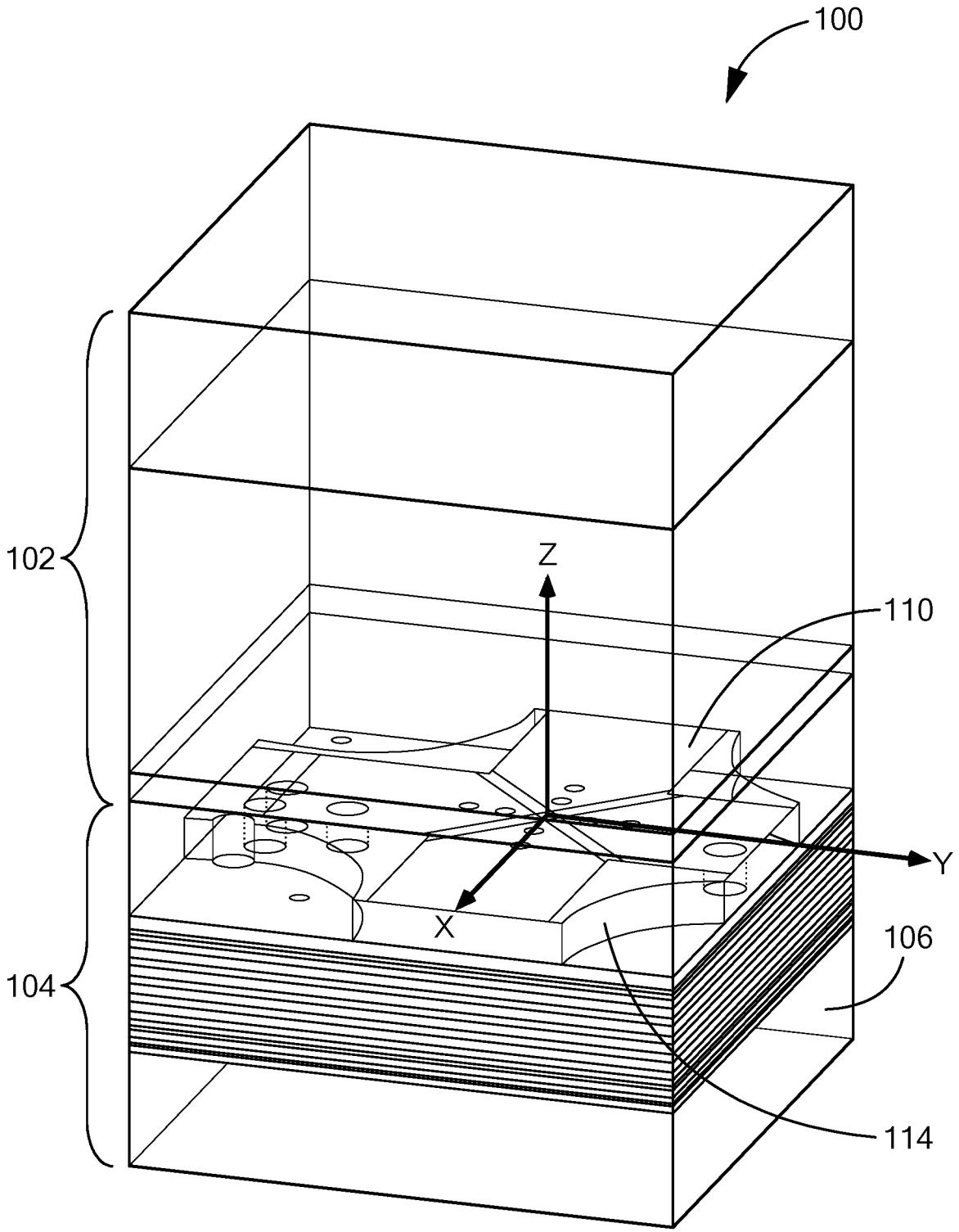
FIG. 1B is a diagram of an example of a unit cell of the phased array antenna.
Figure 2A:
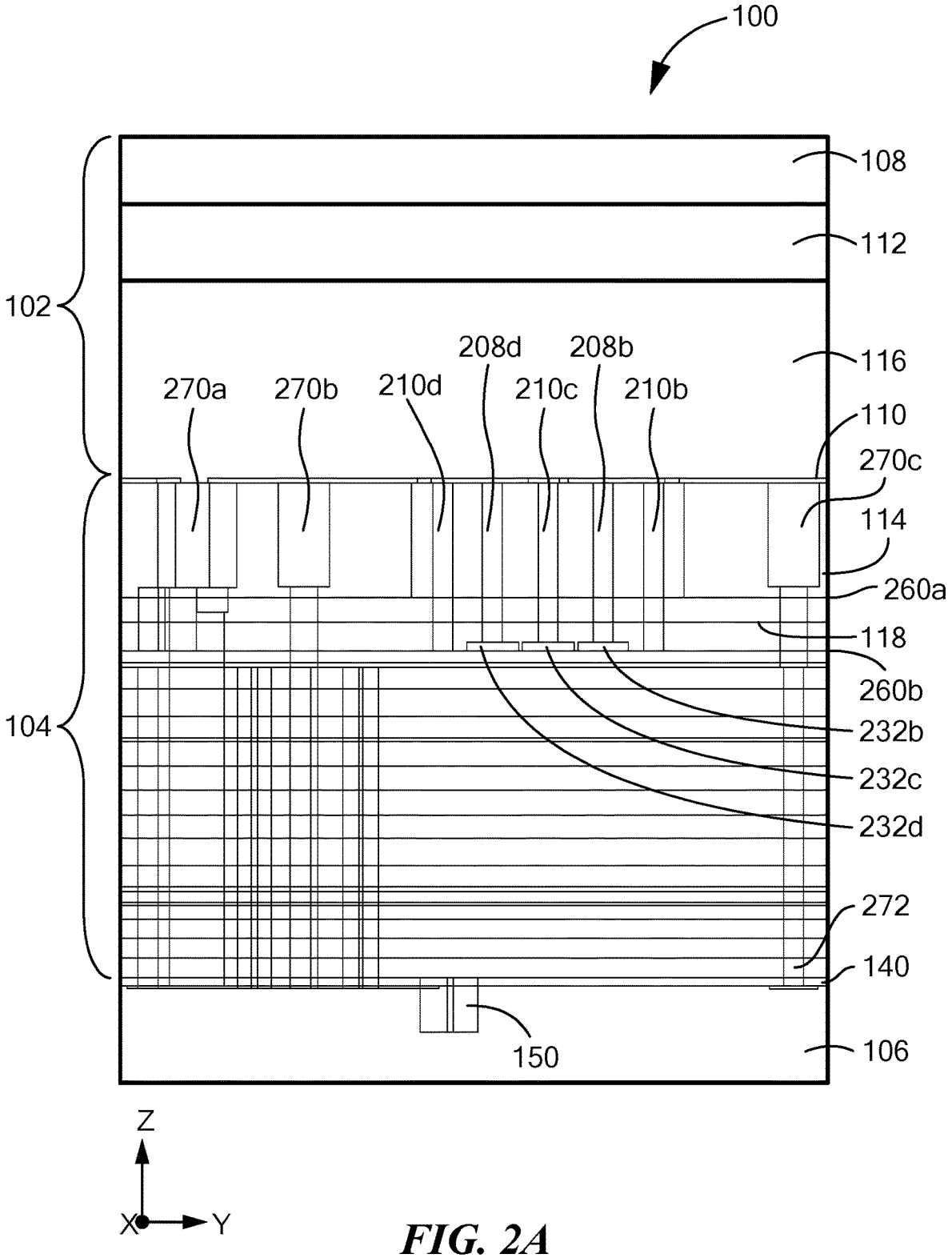
FIG. 2A is a diagram of an example, of a side view of the unit cell of FIG. 1B.
Figure 2C:
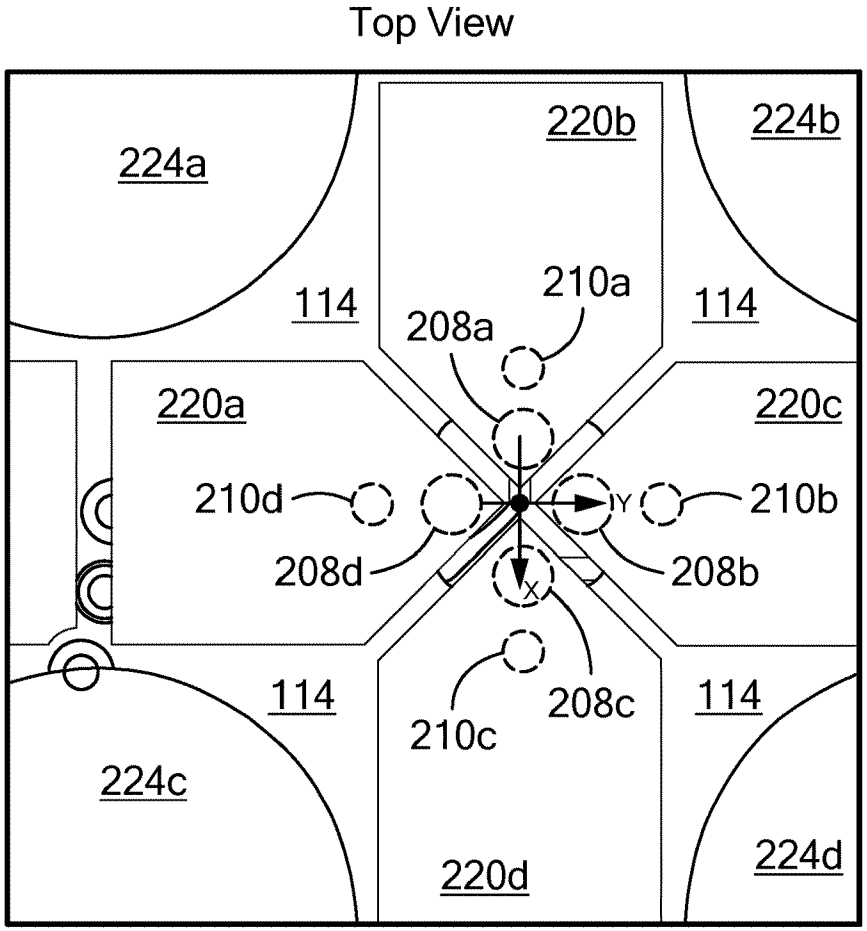
FIG. 2C is a diagram of an example of a top view of the unit cell of FIG. 1B.
Figure 2B:
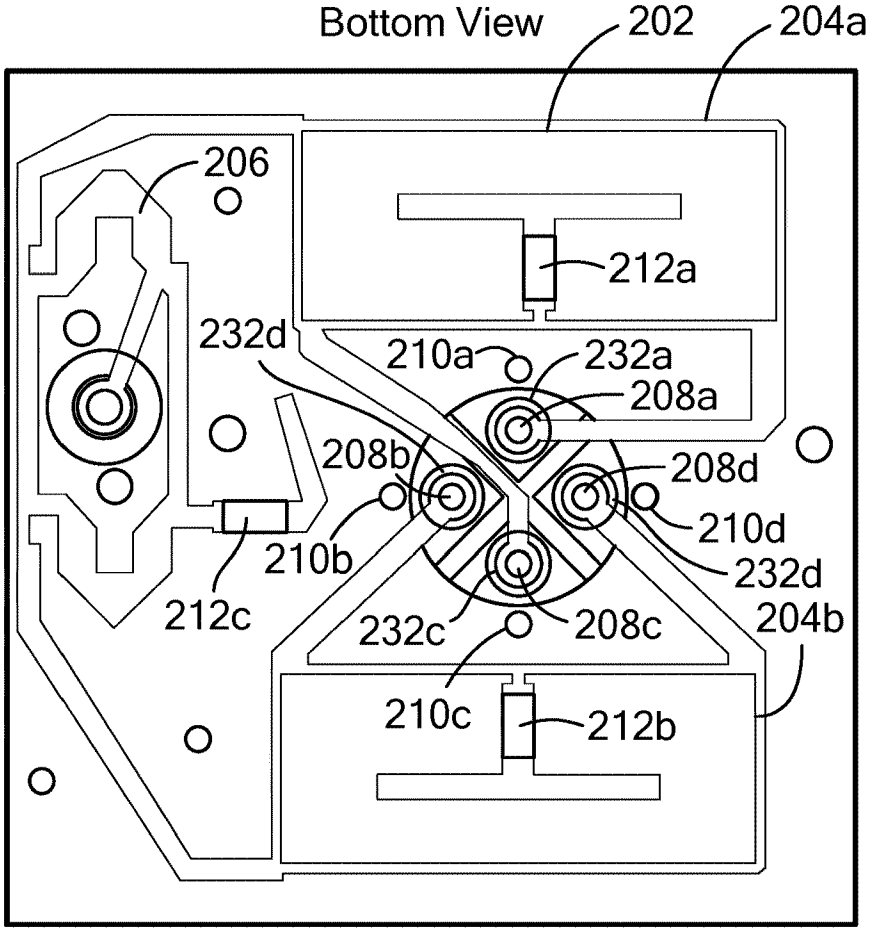
FIG. 2B is a diagram of an example of a bottom view of the unit cell of FIG. 1B.
Figure 4:
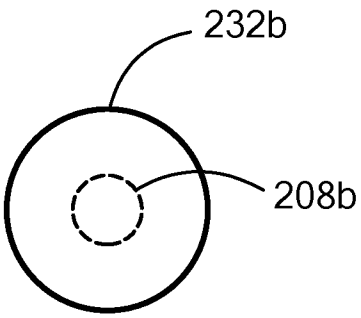
FIG. 4 is a diagram of a bottom view of one example of a backdrill and a corresponding via.
Figure 3:
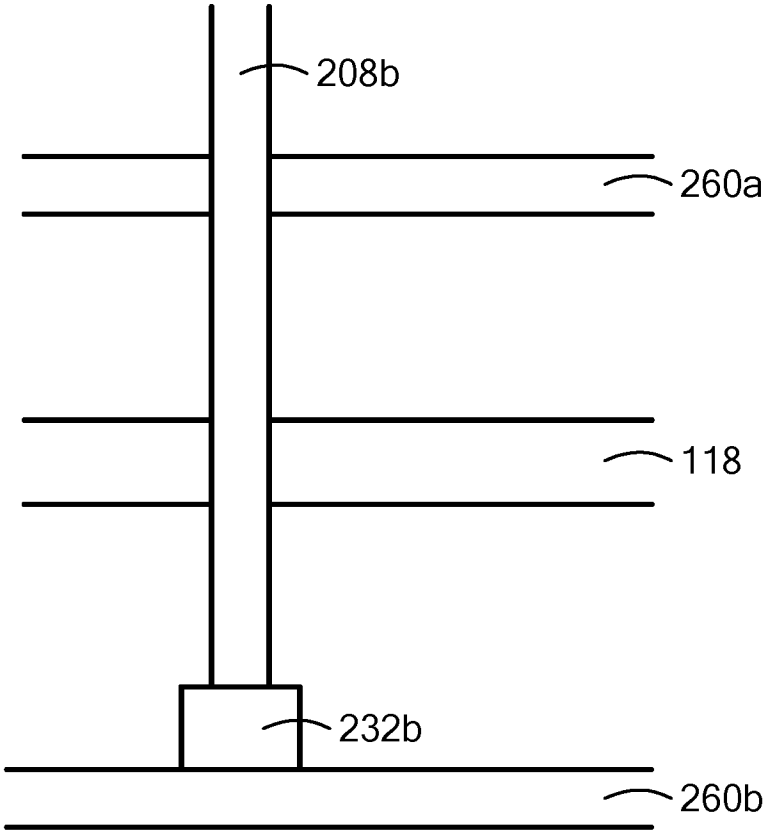
FIG. 3 is a detailed diagram of an example of layers around a feed layer of FIG. 2A.

Referring to FIGS. 1A and 1B, a phased array antenna 10 includes unit cells (e.g., a unit cell 100). In some examples, the phased array antenna 10 may be shaped as a rectangle, a square, an octagon and so forth. The unit cell 100 comprises a radome portion 102, a printed wiring board (PWB) 104 and an active layer 106 where active components are attached to layer 140 as shown in FIG. 2A. The PWB 110 includes a radiator 110 that is disposed on a dielectric 114.

Referring to FIGS. 2A to 2C, 3 and 4 the radome 102 includes a wide-angle impedance matching (WAIM) layer 112 between two air layers 108, 116. The active layer 104 includes air and active components 150 attached to the PWB 104 on layer 140.

The PWB 104 includes a radiator layer 110. The radiator layer 110 includes a radiator having four dipole arms (e.g., a dipole arm 220*a*, a dipole arm 220*b*, a dipole arm 220*c* and a dipole arm 220*d*). The dipole arms 220*a*-220*d* are excited by a feed circuit 202 (FIG. 2B) located at the feed layer 118 using vias. In one example, each dipole arm 220*a*-220*d* is connected to the feed layer by a corresponding via that extends through the dielectric 114. For example, the dipole arm 220*a* is connected to the feed circuit 202 by a via 208*a*, the dipole arm 220*b* is connected to the feed circuit 202 by a via 208*b*, the dipole arm 220*c* is connected to the feed circuit 202 by a via 208*c*, and the dipole arm 220*d* is connected to the feed circuit 202 by a via 208*d*.

Vias 208*a*-208*d* are backdrilled and filled with backdrill fill material to prevent the vias- 208*a*-208*d* from connecting to the ground plane 260*b*. For example, the via 208*a* is backdrilled from layer 260*b* and then filled with backdrill material 232*a*, the via 208*b* is backdrilled from layer 260*b* and then filled with backdrill material 232*b*, the via 208*c* is backdrilled from layer 260*b* and then filled with backdrill material 232*c* and the via 208*d* is backdrilled from layer 260*b* and then filled backdrill material 232*d*. The backdrills of these four vias 208*a*-208*d* are done in the same processing step and the filling of the four vias 208*a*-208*d* is also done in one processing step. The spacing between the radiator layer 110 and a ground plane 260*a* is typically around an eighth of a wavelength (so that with the image it is effectively a quarter wavelength) in the material (dielectric 114) between the radiator layer 110 and the ground plane 260*a*. In one example, the backdrill fill material is a permanent plug hole plugging ink such as PHP900 permanent hole plugging ink by San-El Kagaku Co. LTD.

Each of the dipole arms 220*a*-220*d* is grounded to the ground plane 260*a*, 260*b* by a corresponding via. For example, the dipole arm 220*a* is grounded using a via 210*a*, the dipole arm 220*b* is grounded using a via 210*b*, the dipole arm 220*c* is grounded using a via 210*c* and the dipole arm 220*d* is grounded using a via 210*d*. In one example, one or more of the vias 210*a*-210*d* are added at a particular distance from a respective via 208*a*-208*d* to control tuning.

The PWB 104 may also include other vias (e.g., a via 272) that extend through the PWB 104. The PWB 104 includes other backdrill operations and backfill material. For example, the dielectric 114 includes backdrilled material 270*a*-270*c*. The purpose of the backdrill fill material is to fill the hole created by the backdrill operation that separates the through vias from ground, which is done to simplify board construction by allowing more layer to layer connections to be made for a given number of laminations. The backdrill separates the via from the outer layers, but creates an exposed hole. This hole is filled with backdrill fill material (e.g., PHP900 by SAN-EI KAGAKU CO., LTD). That material is often plated over to provide electrical shielding.

In one example, the feed circuit 202 is a quadrature phase feed circuit. The feed circuit 202 includes a rat-race coupler 204*a* connected to the dipole arm 220*a* using the via 208*a* and the dipole arm 220*c* using the via 208*c* and a rat-race coupler 204*b* connected to the dipole arm 220*b* using the via 208*b* and the dipole arm 220*d* using the via 208*d*. The signals to the dipole arms 220*a*, 220*c* are 180° out of phase from one another and the signals to the dipole arms 220*b*, 220*d* are 180° out of phase from one another. In one example, the signals to the dipole arms 220*a*, 220*b* are 90° out of phase from one another and the signals to the dipole arms 220*c*, 220*d* are 90° out of phase from one another. In one particular example, the feed circuit 202 provides signals to the dipole arms 220*a*-220*d* using right hand circular polarization (RHCP).

The feed circuit 202 also includes a branch coupler 206 that connects to the rat-race couplers 204*a*, 204*b*. The rate race-coupler 202*a* includes a resistor 212*a*, the rat-race coupler 202*b* includes a resistor 212*b* and the branch coupler 206 includes a resistor 212*c*. The resistors 212*a*-212*c* provide isolation between the first rat-race coupler 202*a*, the second-rat-race coupler 202*b* and the branchline coupler 206, which improves scan performance. The branch coupler 206 is connected to a via 272, which is connected to a signal layer 140 where the active devices 150 are connected. In other examples, other methods of RF connection within the PWB may be used to connect the feed circuit 202 to the signal layer 140.

Portions of the dielectric 114 are removed to improve scan performance. In one example, a 0.25-inch drill is used to drill four holes 224*a*-224*d* to remove the dielectric 114.

The radiator can be tuned in several ways to optimize frequency of operation, polarization characteristics, and scan volume. Tuning features include via locations, dielectric constant and material thickness, pattern of the radiator circuit, spacing of the feed vias, and design of the feed circuitry. For some applications, control depth drills may be used the selectively remove dielectric material between the radiator circuit and the backplane to improve performance. The use of through metallized vias and control depth drills is also used to achieve connect the ground of the radiator and feed layer to the grounds of the CCA. This simplifies PWB construction and helps avoid the use of more expensive technology such as separate PWBs that require connectors or other interconnect components. The location and size of drills can be used as tuning features. Tightly coupled parasitic tuning elements can also be used near the radiator circuit layer for some designs to improve performance and/or reduce the depth of the radiator. The current loop feature such being low profile and being a well-grounded structure allows the current loop to offer improved grating lobe performance.

Figure 5:
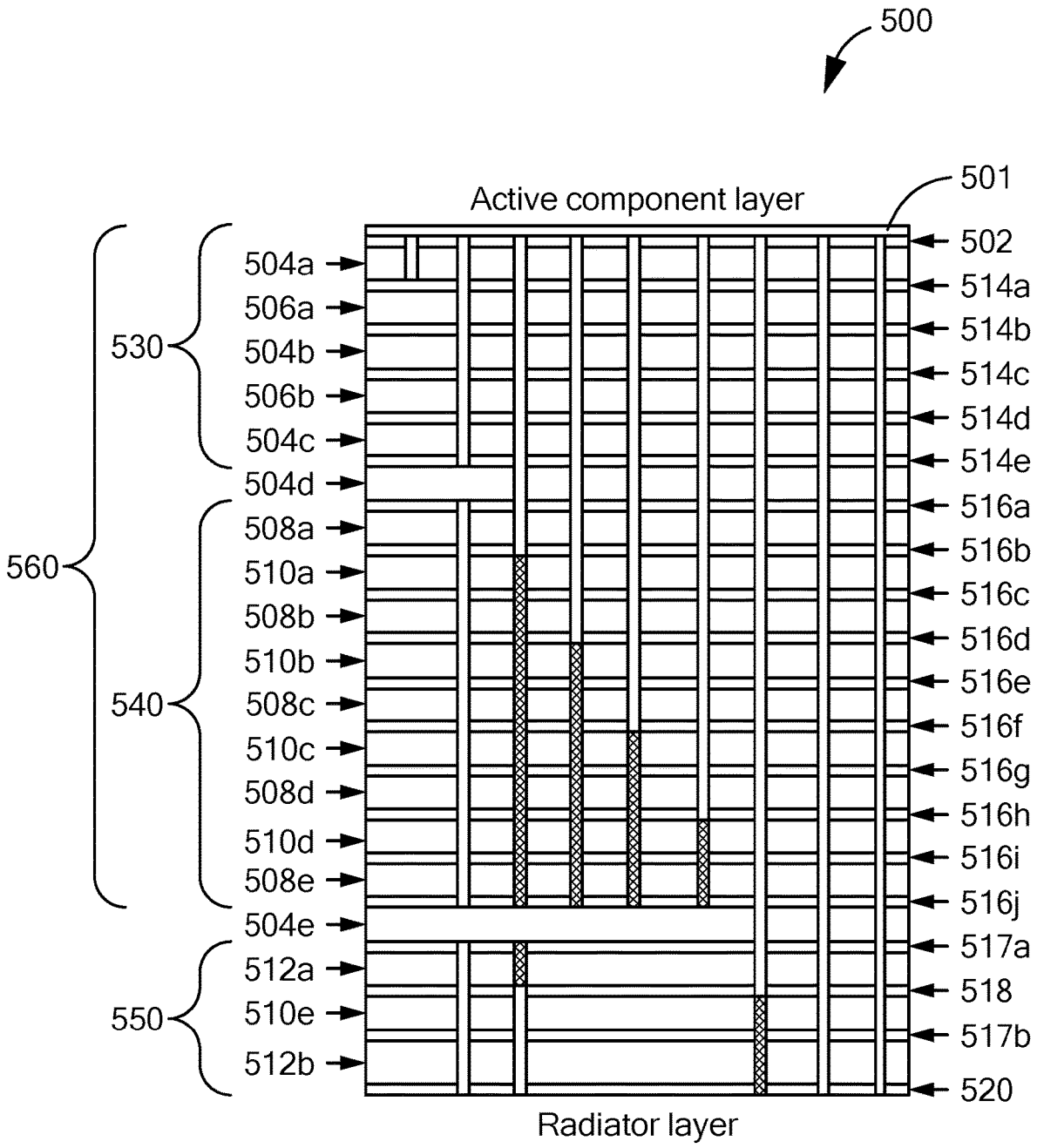
FIG. 5 is a diagram of an example of a printed wiring board (PWB).

Referring to FIG. 5, an example of a PWB 104 is a PWB 500. In one example, the materials to fabricate the PWB 500 are materials compatible with FR4 processing. The PWB 500 includes a solder mask layer 501, a microstrip signal layer 502, stripline layers 516*a*-516*j*, power/ground layers 514*a*-514*e*, ground planes 517*a*-517*b*, a stripline feed signal layer 518. In this example, the feed layer is in the stripline signal layer 518 (e.g., feed circuit 202 (FIG. 2B) and the radiator layer is in the signal/patch layer 520. In this example, active components (e.g., active component 150) are bonded to the microstrip signal layer 502.

In one example, the solder mask 501 is a patterned LPI solder mask. In one example, the microstrip signal layer 502 includes copper and gold plating. In one example, the signal layers include copper. In one example, the power/ground layers include copper or copper plating. In one example, the stripline signal layer 518 includes Ticer TCR25 OPS (The manifold stripline layers 516*a*-516*j* may also have TICER TCR 25 OPS). In one example, the signal/patch layer 520 includes copper and silver plating.

Interposed between the metal layers are first material layers 504*a*-504*e*, second layers 506*a*-506*b*, third material layers 508*a*-508*e*, fourth material layers 510*a*-510*e* and fifth material layers 512*a*-512*b*. The PWB 500 also includes vias (e.g., a metal via 550) extending through the layers. Some of the vias include backfill material 552.

In one example, the first material layers 504*a*-504*e* are a phenyl ether blend resin material such as, for example, Megtron 6 manufactured by Panasonic. In one example, the second material layers 506*a*-506*b* are a high frequency laminate such as, for example, RO4360G2 manufactured by Rogers Corporation. In one example, the third material layers 508*a*-508*e* are a laminate, such as, for example, RO4350B manufactured by Rogers Corporation. In one example, the fourth material layers 510*a*-510*e* are a bond ply, such as, for example, RO4450F manufactured by Rogers Corporation. In one example, the fifth material layers 512*a*-512*b* are a laminate, such as, for example, RO4003 manufactured by Rogers Corporation.

Care is taken in stackup formation to reduce the number of laminations required in the PWB build to reduce cost and complexity. Additionally, the choice of prepregs in the PWB stackup has been developed to allow for higher number of laminations to help minimize producibility risks. The use of FR4 processing compatible materials is used to allow for high aspect ratio vias and reduced cost in fabrication. Because of these developments, no connectors and additional assembly is required to connect the radiator to the CCA. It achieves low cost, low profile, simple integration in a manner like the patch radiator, but with improved performance due to its lower Q nature.

In one example, the layers 501, 502, 504*a*-504*c*, 506*a*-506*b*, 514*a*-514*e* are laminated together to form substructure 530. The layers 508*a*-508*e*, 510*a*-510*d*, 516*a*-516*j* are laminated together to form a substructure 540. The layers 510*e*, 512*a*-512*b*, 517*a*, 517*b*, 518, 520 are laminated together to form the substructure 550. The substructure 530 is laminated to the substructure 540 using the layer 504*d* to form a substructure 560. The substructure 560 is laminated to the substructure 550 using the layer 504*e* to form the PWB 500.

Figure 6A:
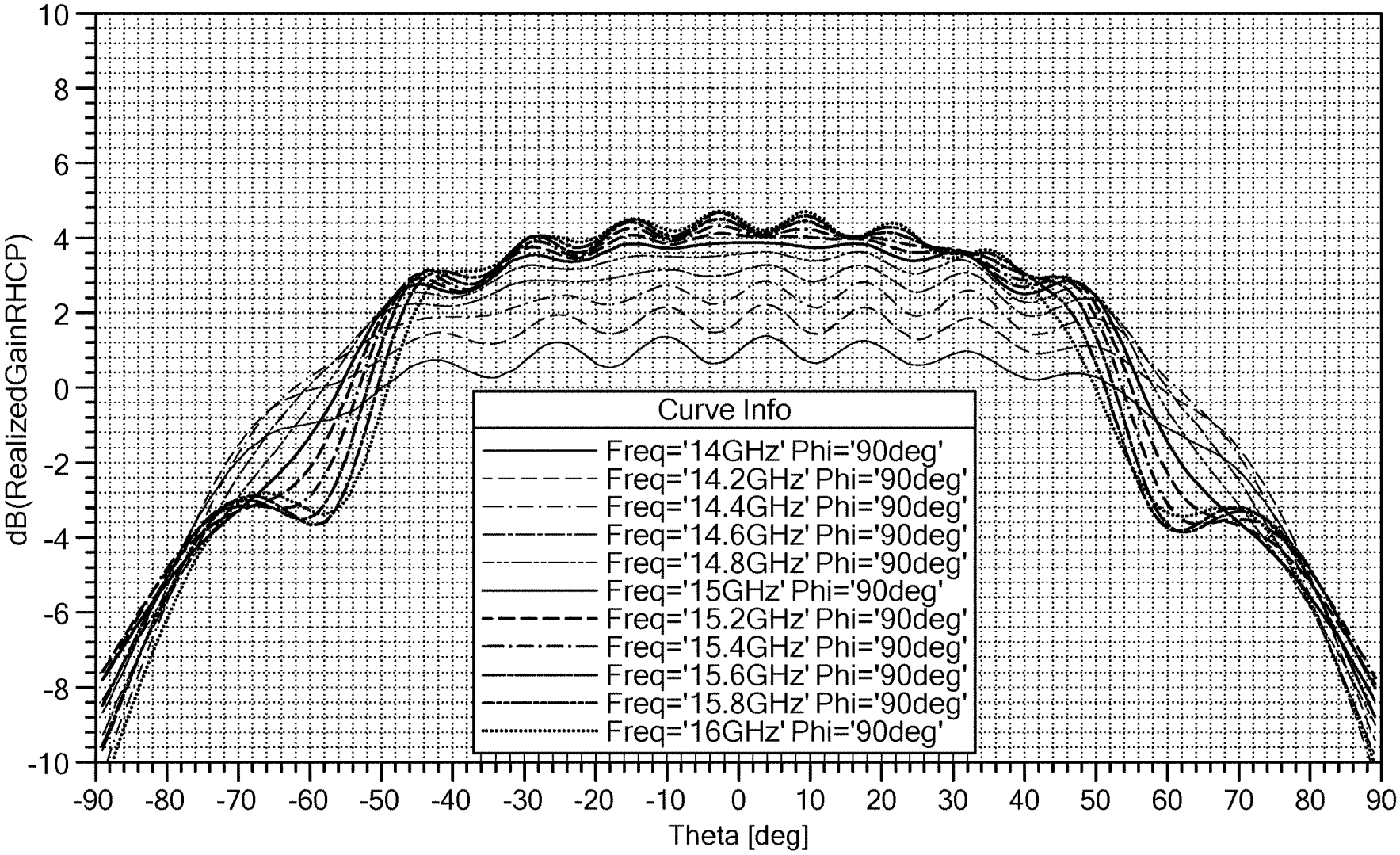
FIG. 6A PRIOR ART
FIG. 6A is a diagram of an example of realized gain versus angle for a patch radiator.
Figure 6B:
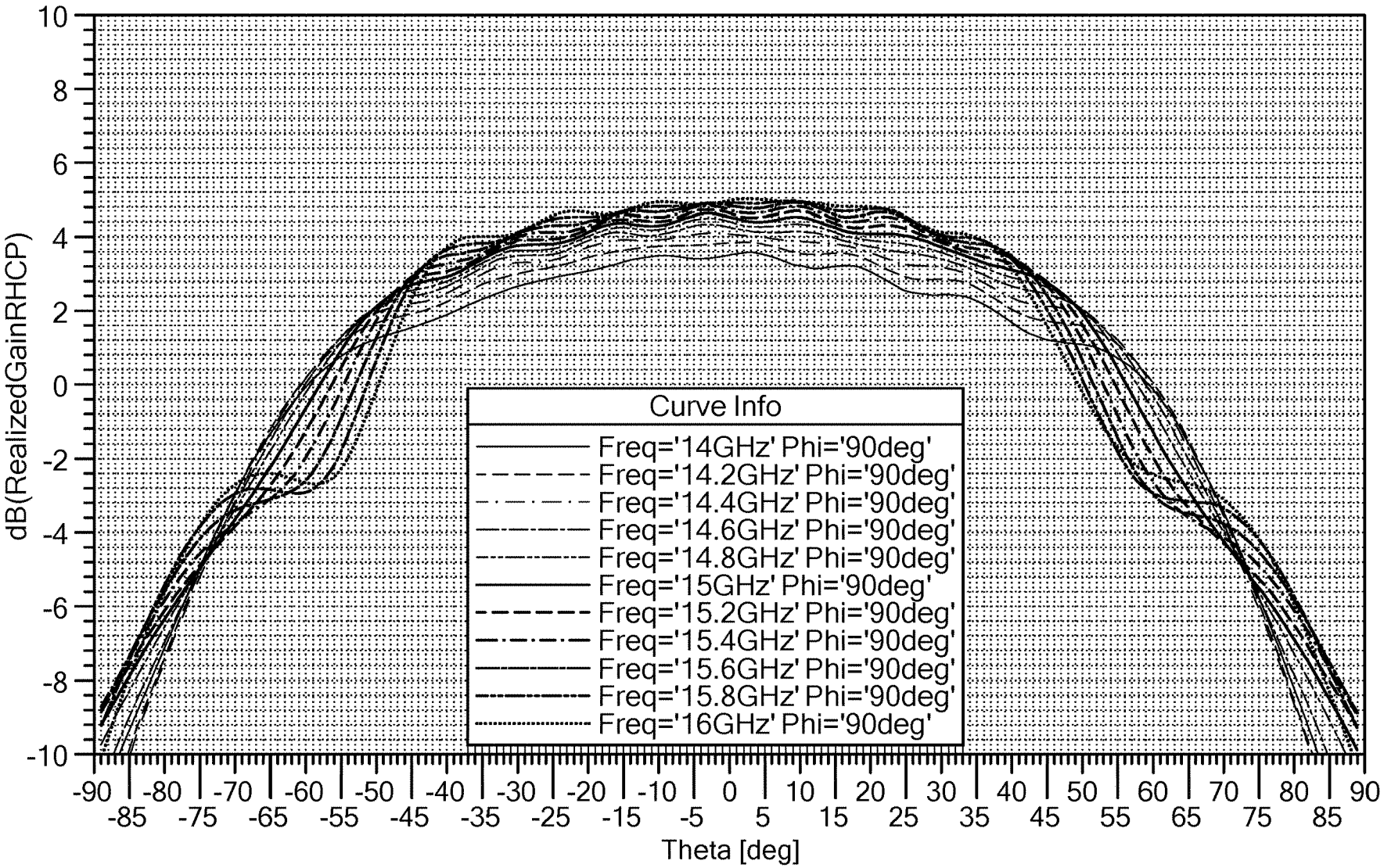
FIG. 6B is a diagram of an example of realized gain versus angle for a current loop radiator.

Referring to FIGS. 6A and 6B, the unit cell 100 is a significant improvement from the patch radiator in realized gain. In FIG. 6A, the realized gain for a patch radiator may vary by more than 4 db. In FIG. 6B, the realized gain of the unit cell 100 varies by only 2 db.

Figure 7A:
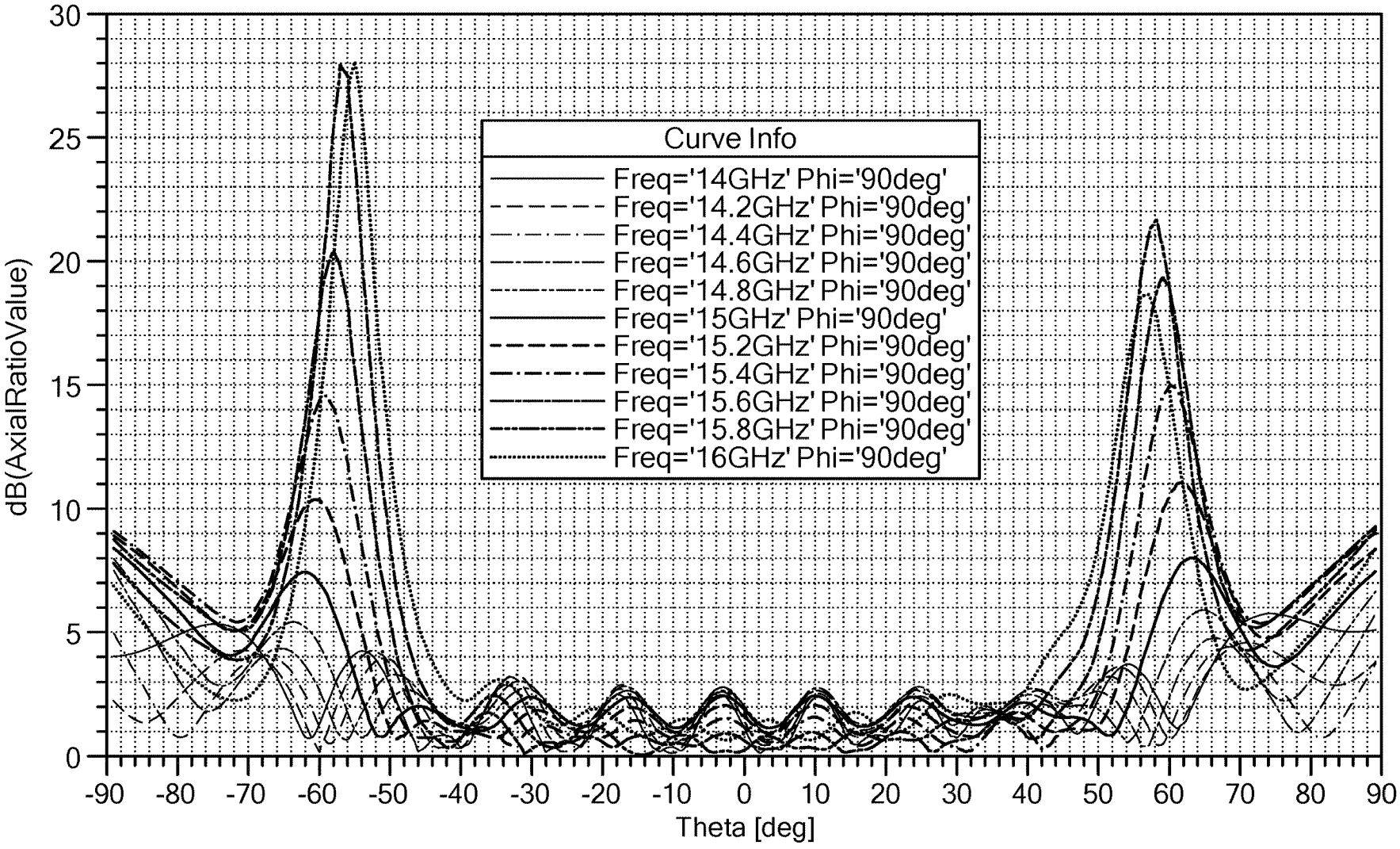
FIG. 7A PRIOR ART
FIG. 7A is a diagram of an example of axial ratio versus angle for the patch radiator.
Figure 7B:
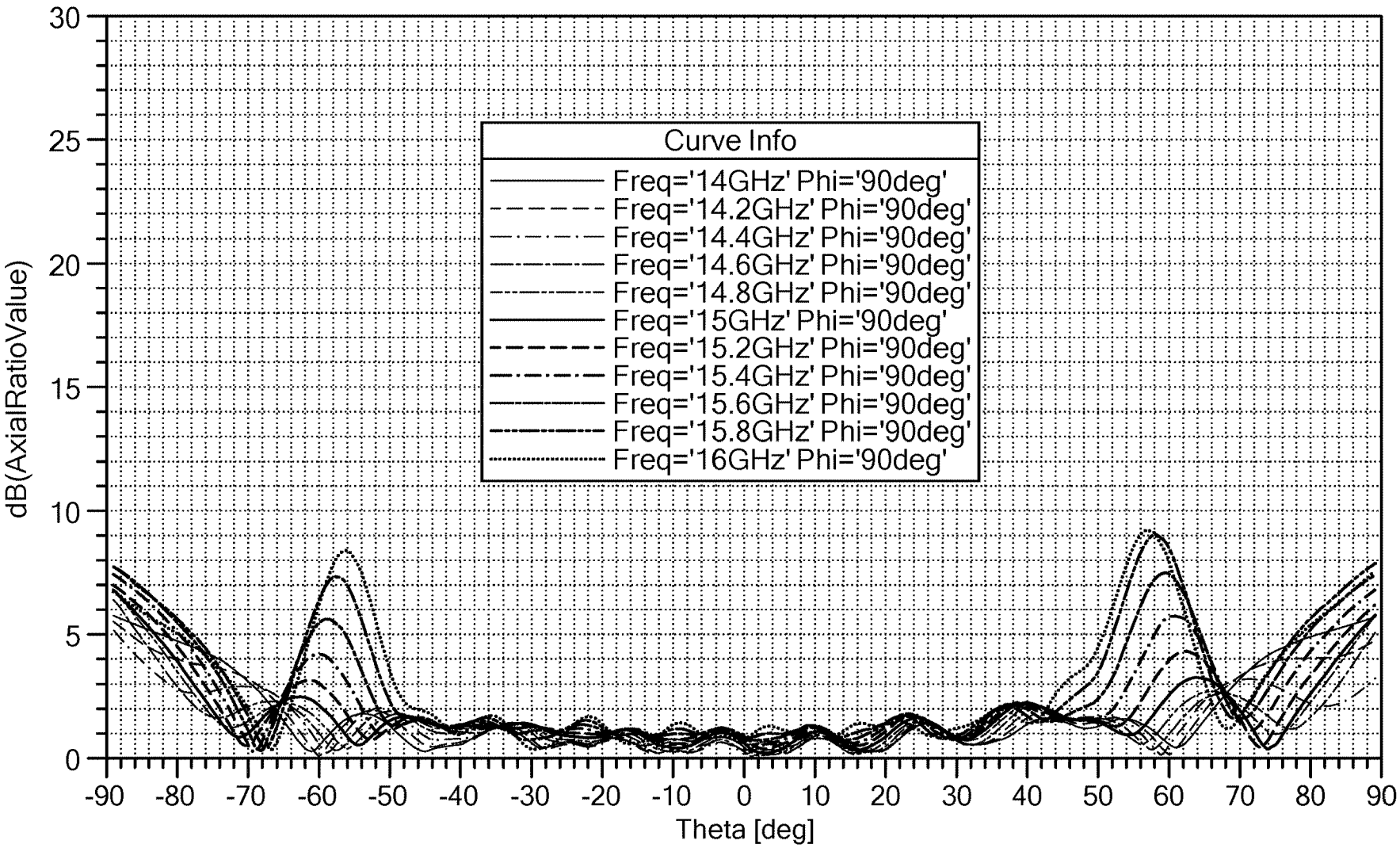
FIG. 7B PRIOR ART
FIG. 7B is a diagram of an example of axial ratio versus angle for a current loop radiator.

Referring to FIGS. 7A and 7B, the unit cell 100 is a significant improvement from the patch radiator in axial ratio value near the grating lobes. In FIG. 7A, for the patch radiator, the axial ratio value, at about + or −60 degrees, is more than 20 db. In FIG. 7B, for the unit cell 100, the axial ratio value, at about + or −60, degrees is less than 10 db.

Figure 8:
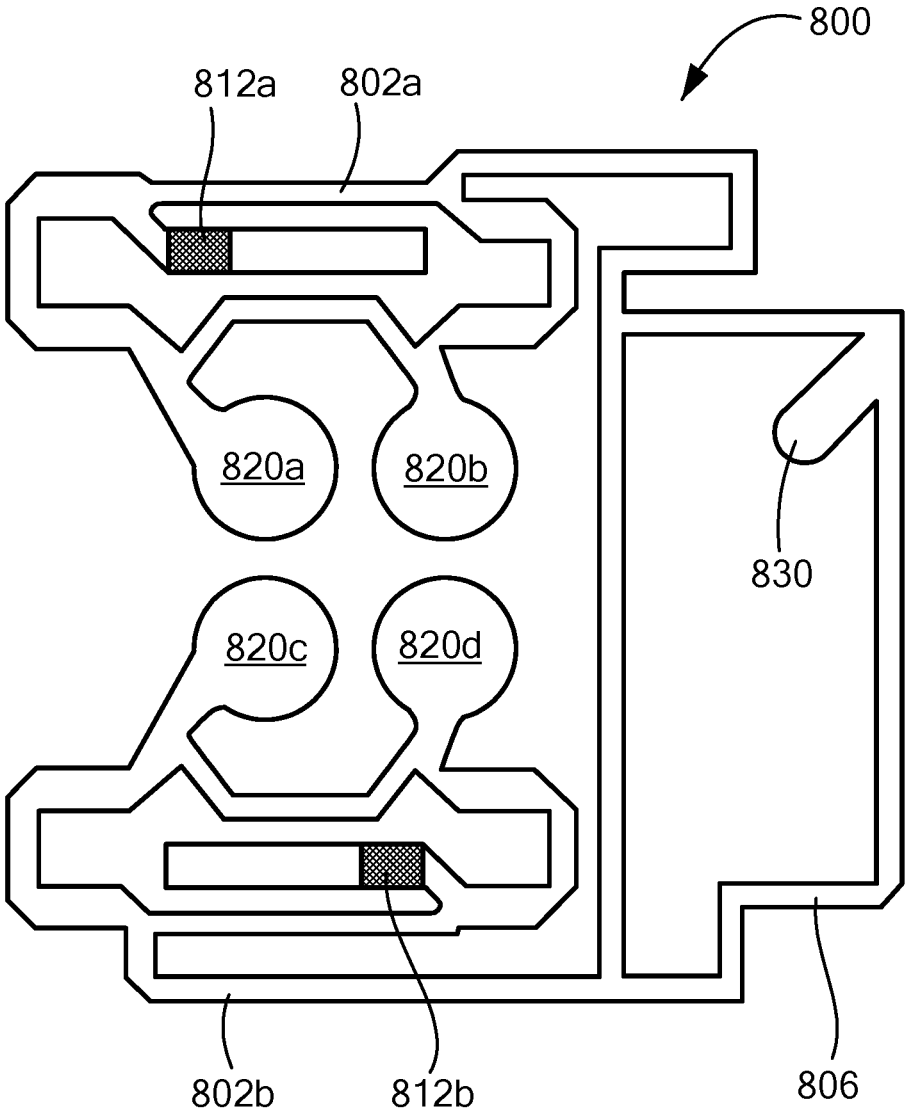
FIG. 8 is a diagram of another example of a feed circuit.

Referring to FIG. 8, another example of a feed circuit is the quadrature feed circuit 800. The feed circuit includes branch couplers 802*a*, 802*b* coupled to a rat-race coupler 806. The branch coupler 802*a* includes pads 820*a*, 820*b* and a resistor 812*a* and the branch coupler 802*b* includes pads 820*c*, 820*d* and a resistor 812*b*. The pads are connected to a corresponding one of the radiator dipole arms 220*a*-220*d* to provide 0°, 90°, 180°, 270° excitation of the radiator. The rat-race coupler 806 includes a pad 830, which connects to a coaxial port to receive signals. In one example, the difference in phase between the signals provided to pads 820*a*, 820*b* is 90° and the difference in phase between the signals provided to pads 820*c*, 820*d* is 90°.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. A unit cell of a phased array antenna comprising: a printed wiring board (PWB) comprising: a first layer comprising a radiator comprising: a first dipole arm; a second dipole arm; a third dipole arm; and a fourth dipole arm; a second layer comprising a quadrature feed circuit configured to generate and output excitation signals to the radiator using right hand circular polarization (RHCP); a first via coupled to the first dipole arm; a second via coupled to the second dipole arm; a third via coupled to the third dipole arm and a fourth via coupled to the fourth dipole arm, wherein the first, second, third and fourth vias provide the excitation signal from the feed circuit, a fifth via coupled to the first dipole arm; a sixth via coupled to the second dipole arm; a seventh via coupled to the third dipole arm and an eighth via coupled to the fourth dipole arm, wherein the fifth, sixth, seventh and eighth vias provide ground; a third layer between the first and second layers, wherein the third layer comprises a dielectric having four rounded corners evenly spaced around the dialecticwherein the feed circuit comprises: a first branchline coupler coupled to the first via and the second via; a second branchline coupler coupled to the third via and the fourth via; a rat-race coupler coupled to the first and second branchline couplers.

2. The unit cell of claim 1, wherein the feed circuit comprises:

a first rat-race coupler coupled to the first via and the third via;

a second rat-race couple coupled to the second via and the fourth via;

a branchline coupler coupled to the first and second rat race couplers.

3. The unit cell of claim 2, wherein signals to the first and third dipole arms are 180° out of phase from one another, and wherein signals to the second and fourth dipole arms are 180° out of phase from one another.

4. The unit cell of claim 3, wherein signals to the first and second dipole arms are 90° out of phase from one another, and wherein signals to the third and fourth dipole arms are 90° out of phase from one another.

5. The unit cell of claim 2, wherein the feed circuit further comprises:

a first resistor coupled to the first rat-race coupler;

a second resistor coupled to the second rat-race coupler; and a third resistor coupled to the branchline coupler, wherein the first, second and third resistors provide isolation between the first rat-race coupler, the second-rat-race coupler and the branchline coupler.

6. The unit cell of claim 1, wherein the four rounded corners are formed using a 0.25-inch drill bit.

7. The unit cell of claim 1, further comprising:

an active component layer comprising an active component bonded to the PWB; and a radome comprising a wide-angle impedance matching (WAIM) layer.

* * * * *